US009309635B2

(12) United States Patent
Liao et al.

(10) Patent No.: US 9,309,635 B2
(45) Date of Patent: Apr. 12, 2016

(54) BRIDGE LIFTING USED THREE-AXIAL PARALLEL MECHANISM

(71) Applicant: China Engineering Consultants, Inc., Taipei (TW)

(72) Inventors: Ching-Lung Liao, Taipei (TW); Min Chao, Kaohsiung (TW); Chung-Yue Wang, New Taipei (TW); Jin-Chung Ma, New Taipei (TW); Chin-Yu Wang, Kaohsiung (TW); Wu-Peng Peng, Taipei (TW)

(73) Assignee: CHINA ENGINEERING CONSULTANTS, INC., Taipei (TW)

( * ) Notice: Subject to any disclaimer, the term of this patent is extended or adjusted under 35 U.S.C. 154(b) by 38 days.

(21) Appl. No.: 14/332,621

(22) Filed: Jul. 16, 2014

(65) Prior Publication Data

US 2015/0097150 A1 Apr. 9, 2015

(30) Foreign Application Priority Data

Oct. 3, 2013 (TW) ..... 102135917 A

(51) Int. Cl.
*B66F 3/46* (2006.01)
*E01D 22/00* (2006.01)

(52) U.S. Cl.
CPC .. *E01D 22/00* (2013.01); *B66F 3/46* (2013.01)

(58) Field of Classification Search
CPC ..... B66F 3/46; B66F 7/16; B66F 7/20; E01D 15/02
See application file for complete search history.

(56) References Cited

U.S. PATENT DOCUMENTS 3,215,391 A * 11/1965 Storm ..... B25J 17/0266 108/4
3,288,421 A * 11/1966 Peterson ..... B23Q 1/5462 108/4
3,504,889 A * 4/1970 Wyrough ..... B66F 7/16 254/2 R
3,577,659 A * 5/1971 Kail ..... B25J 17/0216 248/163.1
3,612,467 A * 10/1971 Terai ..... B66F 7/16 248/396
3,658,286 A * 4/1972 Terai ..... B23Q 1/545 114/79 W
4,374,497 A * 2/1983 Harmand ..... B23Q 1/28 108/147
4,919,382 A * 4/1990 Forman ..... B25J 17/0266 248/178.1
6,161,809 A * 12/2000 Mahy ..... F16M 11/12 108/4
7,305,727 B2 * 12/2007 Horlin ..... A61G 7/0573 5/607

* cited by examiner

*Primary Examiner* — Lee D Wilson
*Assistant Examiner* — Tyrone V Hall, Jr.
(74) *Attorney, Agent, or Firm* — Jackson IPG PLLC; Demian K. Jackson

(57) ABSTRACT

A bridge lifting support bracket is disclosed, which comprises a supporting mechanism, comprising a bracket having a depressed area at a face thereof and a lifting portion disposed at two sides of the bracket, respectively; and at least two jacks, disposed on a bottom face of the lifting portions, respectively. As such, a space for receiving a jack properly is secured by digging out a space of a concrete protection layer of a lower structure and using a supporting mechanism cooperating therewith when only a small space or a closely tight bonding with no seam existing between a bridge and a pier, whereby a lifting process of the bridge may be safely performed.

8 Claims, 6 Drawing Sheets

BRIDGE LIFTING USED THREE-AXIAL PARALLEL MECHANISM

FIELD OF THE INVENTION

The present invention relates to a bridge lifting used three-axial parallel mechanism, and particularly to a bridge lifting used three-axial parallel mechanism where a test adjustment and calibration task prior to a construction may be benefited, so that the bridge has the merits of maintenance on field, strengthening, elevation adjustment and river cross section promotion besides the bridge lifting function, and several to tens of three-axial parallel mechanisms are particularly used to control the synchronous bridge lifting engineering method so that the bridge deck is raised synchronously in its original posture to achieve the efficacy of on-line adjustment, avoid pollution, reconstruction, resource waste, traffic blockage and increased social cost resulting from tear-down of the bridge.

DESCRIPTION OF THE RELATED ART

With the exceptional world climate and earthquake, plus the excessive land development state and the bare conservation of water and soil, piers of a bridge might be scoured and thus uncovered owing to a rushing river, a net elevation of the bridge appears small owing to landslide deposition in the river causing from some mountain landslide, and a ground sag and unstable ground issue resulting from excessive groundwater drawing might arise. Furthermore, the road and bridge have their own maintenance and strengthening issues, forcing the overall draw-up and regulations for the bridge lifting construction engineering method to be indispensable. Particularly, when a rainy season comes, the bridges and rivers are sensible to a downpour and typhoon. At this time, bridge blocking, road blocking and flood may form a menace to human lives and fortunes.

However, the traditional synchronous lifting method, as shown in FIG. 6, a multitude of hydraulic jacks 7 arranged in the same direction are used together to synchronously raise the bridge body. If six one-hundred tons of hydraulic jacks 7 are fixed concurrently, a bridge body of 600 tons may be raised. However, this not only requires the supporting brackets 71 below each of the jacks 7 to be aligned accurately, but also the jacks 7, even manufactured from the same factory, may not go synchronously owing to friction and leakage in the course of lifting.

Furthermore, each of the jacks 7 is contacted with the bridge deck at a single point, and thus a concentrated strain may occur on the lifting points and some local area of the bridge deck, leading to the case where the jacks 7 are apt to be damaged or have an insufficient supporting force.

Furthermore, since the lifting engineering method is affected by the type and lifting purpose of the bridge, some variables may form on the construction. Thus, how to save the resources and a maximum allowable common construction have to be taken into consideration before a construction. With such considerations of the bridge lifting construction, not only the main equipment may be reused in the future, the drawn-up construction flow may effectively promote the construction efficiency.

In view of this, the drawbacks mentioned above, the inventor of the present invention provides a bridge lifting used three-axial parallel mechanism, after many efforts and researches to overcome the shortcoming encountered in the prior art. Not only a module may be used to replace the conventional integrated use of two to three jacks, the bridge deck may be adjusted for alignment in a vertical, a lateral, and a side directions. In addition, a free rotational dimensional may also be provided so that an inclination angle fine-tune function may be used for a relatively higher inclination at an outer bridge deck required from a curved place of the bridge path, whereby overcoming the various issues encountered in the prior art.

SUMMARY OF THE INVENTION

It is, therefore, an object of the present invention to provide a movable platform contacting with a bridge body to avoid a concentrated strain, and a coordination among a respective rotational axis of a first, second and third lifting units are provided to achieve in a three-axial shift adjustment in a longitudinal, a lateral, and a side directions and a one-dimensional bridge deck inclination angle adjustment. Besides a use for the bridge lifting engineering, a test adjustment and calibration task prior to a construction, the bridge has the merits of maintenance on field, strengthening, elevation adjustment and river cross section promotion besides the bridge lifting function, and several to tens of three-axial parallel mechanisms are particularly used to control the synchronous bridge lifting engineering method so that the bridge deck is raised synchronously in its original posture to achieve the efficacy of on-line adjustment, avoid pollution, reconstruction, resource waste, traffic blockage and increased social cost resulting from tear-down of the bridge.

To achieve the above objects, the bridge lifting used three axial parallel mechanism according to the present invention comprises a stationary platform; a movable platform, disposed corresponding to the stationary platform; a first lifting unit, movably disposed at an end of the stationary platform with one end thereof and an end of the movable platform with the other end; a second lifting unit, movably disposed at an end of the stationary platform with one end thereof and end of the movable platform with the other end; a third lifting unit, movably disposed at the other end of the stationary platform with one end thereof and an end of the movable platform with the other end.

In an embodiment, the first lifting unit comprises a jack, a rotational axis connection seat disposed at a top end of the jack, a pivot movably combined with the movable platform and the rotational axis connection seat, a male connector disposed at a bottom end of the jack, a pivot movably combined with the stationary platform and the male connector, and a shift sensor connected to the jack.

In an embodiment, the rotational axis connection seat comprises a connection seat combined with the jack, a sleeve movably combined with the connection seat, and a rotational axis connected to the connection seat and the sleeve.

In an embodiment, the second lifting unit comprises a jack, a pressure sensor male-connector disposed on the top of the jack, a pivot movably combined with the movable platform and the pressure sensor male-connector, a male connector disposed at the bottom end of the jack, a pivot movably combined with the stationary platform and the male connector, and a shift sensor connected to the jack.

In an embodiment, the third lifting unit comprises a jack, a pressure sensor male-connector disposed on the top of the jack, a pivot movably combined with the movable platform and the pressure sensor male-connector, a male connector disposed at the bottom end of the jack, a pivot movably combined with the stationary platform and the male connector, and a shift sensor connected to the jack.

In an embodiment, the first, second and third lifting units is further connected to a control mechanism.

In an embodiment, the control mechanism comprises a processing unit, an operational unit connected to the processing unit, an activation unit connected to the processing unit, a receiving unit connected to the processing unit, and an output unit connected to the processing unit.

BRIEF DESCRIPTIONS OF THE DRAWINGS

The present invention will be better understood from the following detailed descriptions of the preferred embodiments according to the present invention, taken in conjunction with the accompanying drawings, in which.

DESCRIPTION OF THE PREFERRED EMBODIMENTS

Figure 1:
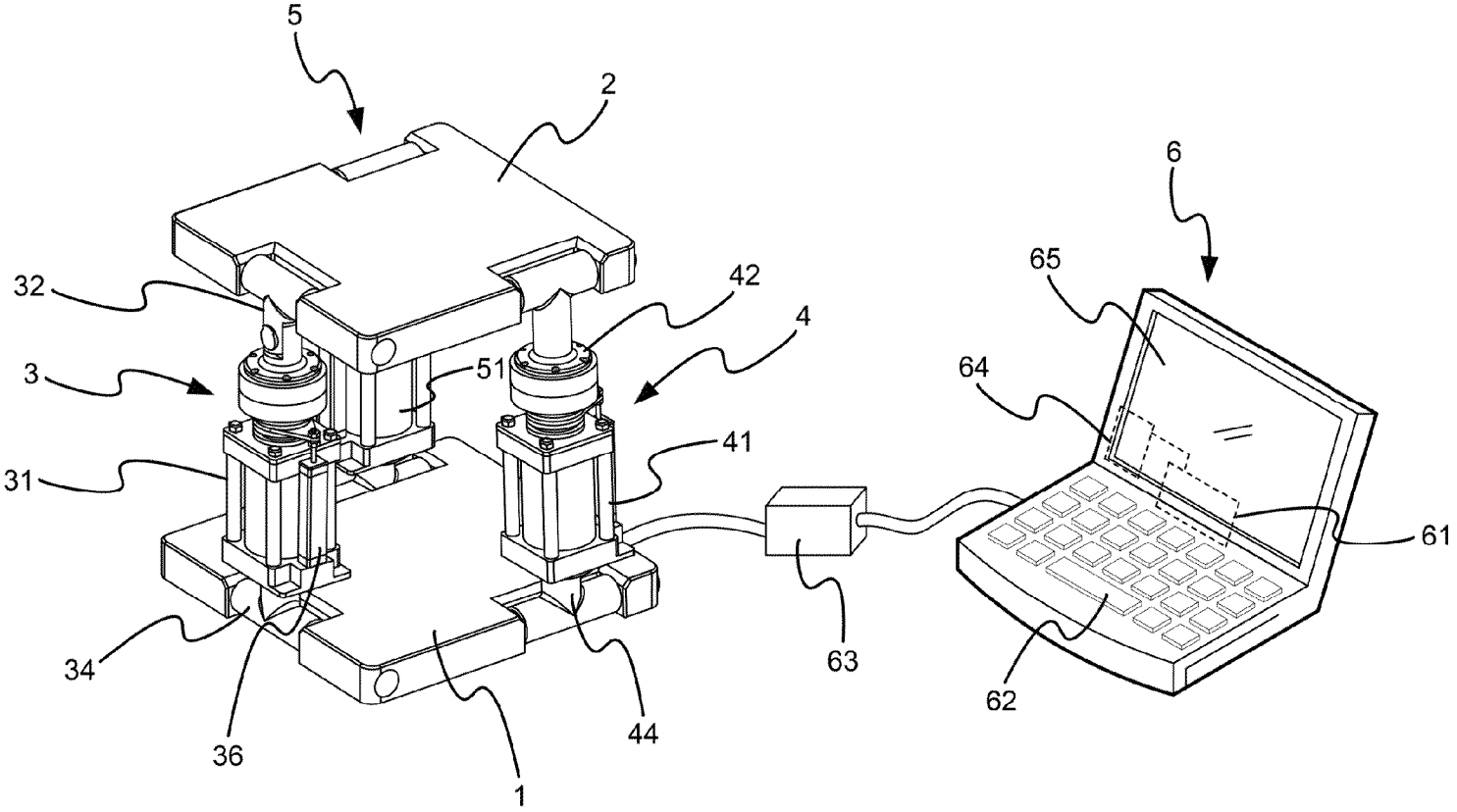
FIG. 1 is a schematic diagram of an outlook of the present invention.
Figure 2:
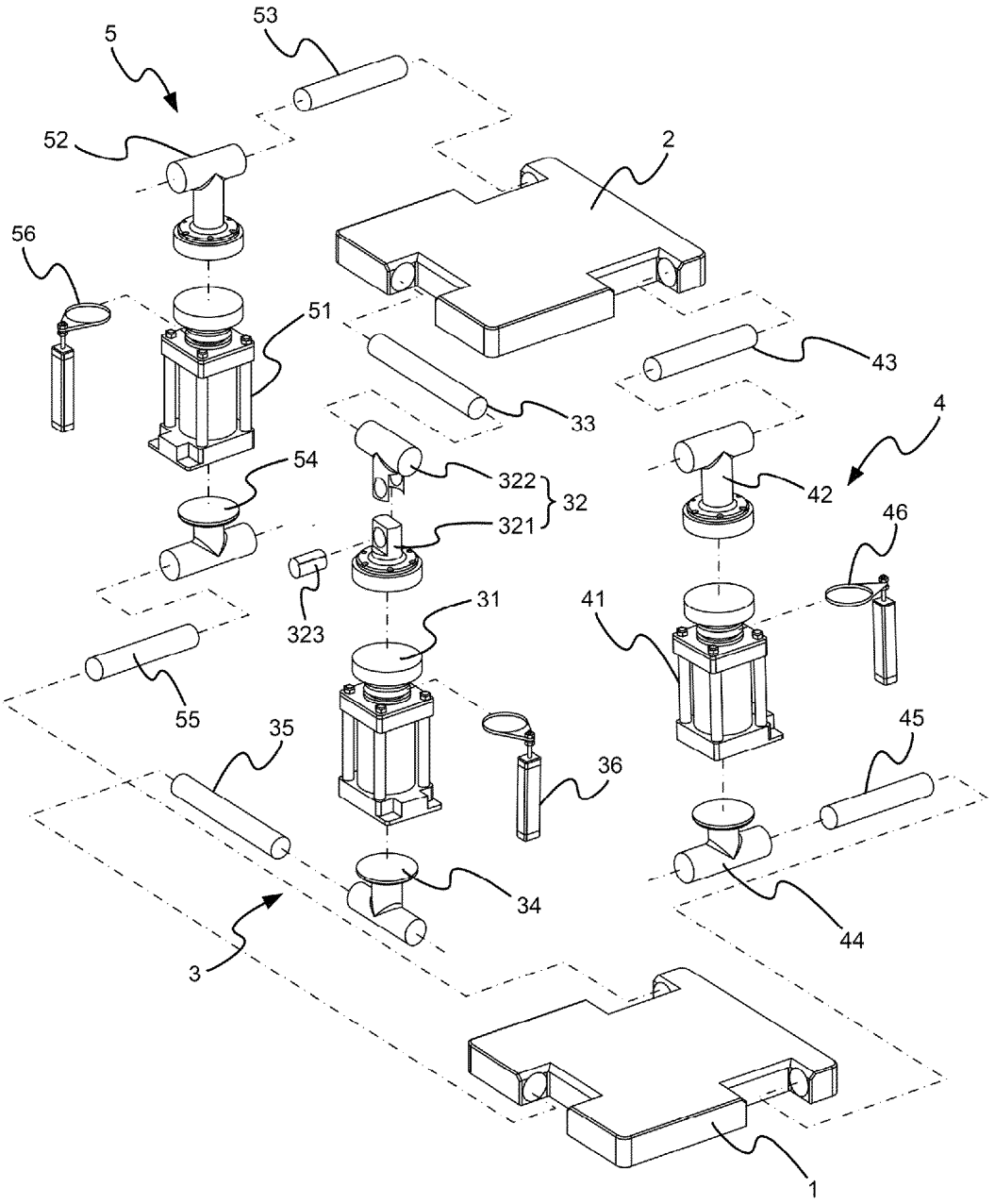
FIG. 2 is a schematic diagram of an exploded view of the present invention.

Referring to FIG. 1 through FIG. 5, a schematic diagram of an outlook, a schematic diagram of an exploded view, a schematic diagram for illustrating how a coordination system is established, a schematic diagram of a translation motion, and an inclination angle, according to the present invention, are shown, respectively. The bridge lifting used three axial parallel mechanism according to the present invention comprises a stationary platform 1, a movable platform 2, a first lifting unit 3, a second lifting unit 4, and a third lifting unit 5.

The stationary platform 1 and the movable platform 2 are disposed corresponding to each other in a longitudinal, a lateral, and a side directions.

The first lifting unit 3 is movably disposed at an end of the stationary platform 1 with one end thereof and at an end of the movable platform with the other end. The first lifting unit 3 comprises a jack 31, a rotational axis connection seat 32 disposed at a top end of the jack 31, a pivot 33 movably combined with the movable platform 2 and the rotational axis connection seat 32, a male connector 34 disposed at a bottom end of the jack 31, a pivot 35 movably combined with the stationary platform 1 and the male connector 34, and a shift sensor 36 connected to the jack 31. Further, the rotational axis connection seat 32 comprises a connection seat 321 combined with the jack 31, a sleeve 322 movably combined with the connection seat 321, and a rotational axis 323 connected to the connection seat 321 and the sleeve 322. The second lifting unit 4 is movably disposed at an end of the stationary platform 1 with one end thereof and end of the movable platform 2 with the other end. The second lifting unit 4 comprises a jack 41, a pressure sensor male-connector 42 disposed on the top of the jack 41, a pivot 43 movably combined with the movable platform 2 and the pressure sensor male-connector 42, a male connector 44 disposed at the bottom end of the jack 41, a pivot 45 movably combined with the stationary platform 1 and the male connector 44, and a shift sensor 46 connected to the jack 41.

The third lifting unit 5 is movably disposed at the other end of the stationary platform 1 with one end thereof and end of the movable platform 2 with the other end. The third lifting unit 5 comprises a jack 51, a pressure sensor male-connector 52 disposed on the top of the jack 51, a pivot 53 movably combined with the movable platform 2 and the pressure sensor male-connector 52, a male connector 54 disposed at the bottom end of the jack 51, a pivot 55 movably combined with the stationary platform 1 and the male connector 54, and a shift sensor 56 connected to the jack 51.

When the present invention is operated, a control mechanism 6 is connected to the first, second and third lifting units 3, 4, 5, and the control mechanism 6 comprises a processing unit 61, an operational unit 62 connected to the processing unit 61, an activation unit 63 connected to the processing unit 61, a receiving unit 64 connected to the processing unit 61, and an output unit 65 connected to the processing unit 61. In operation, the activation is connected to the jacks 31,41, 51 of the first, second and third lifting units 3,4,5, respectively, and the rotational axis connection seat 32. And, the shift sensors 36,46,56 and the pressure sensor male-connectors 42,52 are connected to the receiving unit 64.

As such, the movable platform 2 is contacted with the bridge body (not shown) to avoid a concentrated strain. Further, an operational unit 62 is used together with the processing unit 61, so that the activation unit 63 activates each of the jacks 31,41,51, and the rotational axis connection seat 32, the pressure sensor male-connectors 42,52, the pivots 33,35,43, 45,53,55, and the male-connectors 34,44,54 are used together to adjust a straight line 3-dimensional and a 1-dimensional movement of the bridge body. Further, the receiving unit 64 receives a current movement position signal and a state signal regarding if a non-uniform pressure occurs of the jacks 31, 41, 51 (which examines if a void leg phenomenon occurs on the jacks of the present invention), respectively, according to the shift sensors 36,46,56, the rotational axis connection seat 32, the pressure sensor male connectors 42,52.

The signals are then operated by the processing unit 61 and thus displayed by the output unit 65, so that an operational clerk may conduct an adjustment and calibration task according to the data.

Figure 3:
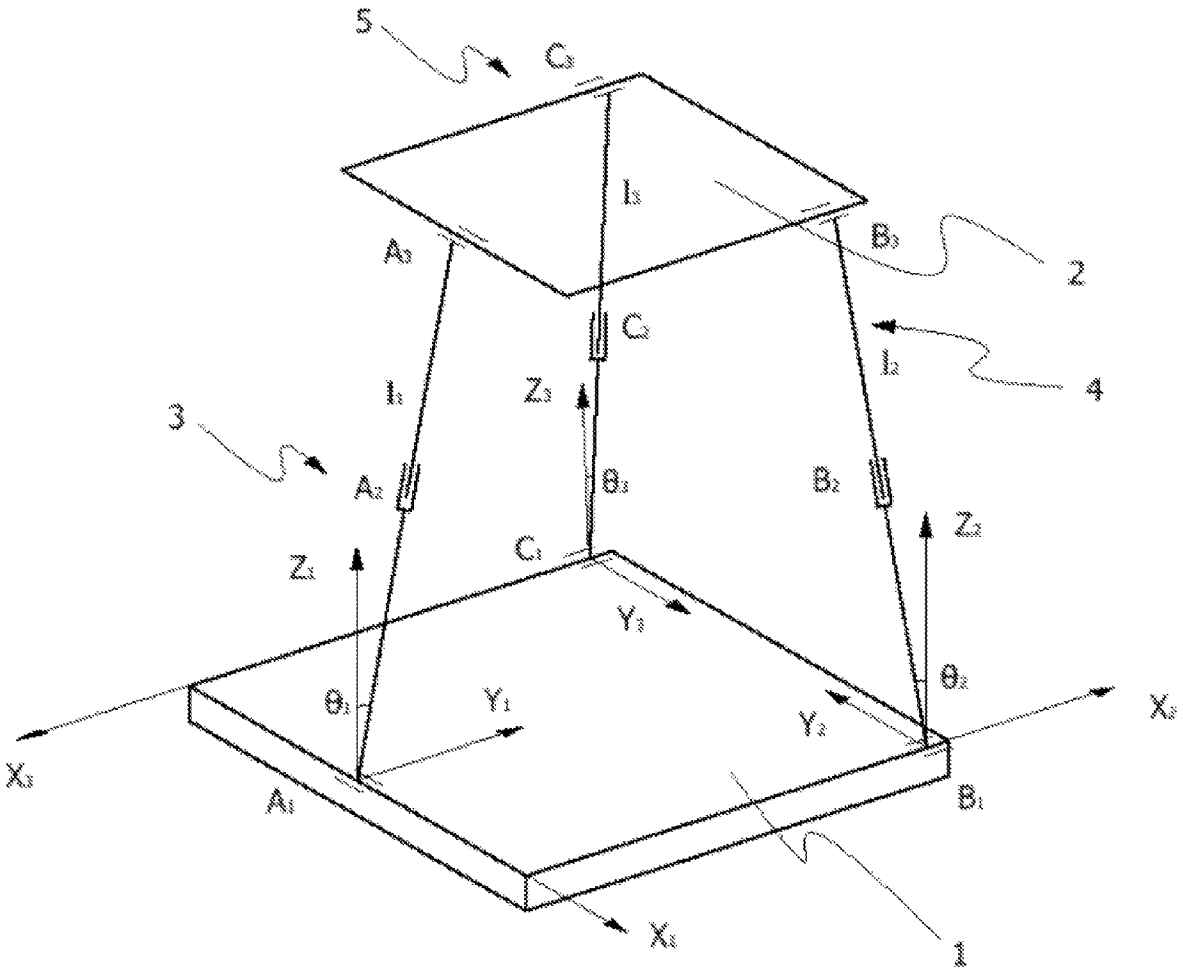
FIG. 3 is a schematic diagram for illustrating how a coordination system is established according to the present invention.

How the jacks 31,41,51 of the first, second and third lifting units 3,4,5, respectively, are operated may be seen from FIG. 3, in which A1, A2, and A3 are taken as original points to form a coordination system, wherein Xi (i=1, 2, 3) axes are parallel to a corresponding side, respectively, Zi (i=1, 2, 3) axes extend vertically upwards, Yi (i=1, 2, 3) axes have their directions determined by the right-handed principle. A1, X1, Y1 and Z1 coordination systems are selected as fixed coordination systems, and the other two coordination systems are reference coordination systems.

In FIG. 3, θ1, θ2 and θ3 represent A1, A3 and Z1 axes of the first lifting unit 3, respectively. Included angles between B1, B3 and Z2 axes of the second lifting unit 4 and positive C1, C3 and Z3 axes have their definitions where a counterclockwise direction is taken as positive viewed from the negative Xi axes. li (i=1, 2, 3) indicate a length of the first, second and third lifting units 3, 4, 5, respectively.

Since in the implementation of the synchronous lifting engineering method, the effects of the jacks performing efficiency and the hard alignment of the stationary platform 2 exist, the bridge deck is adjusted with its required space alignment information by arranging a posture of the movable platform 2 of the three-axial parallel mechanism. This adjustment process is executed by the control mechanism 6, where the receiving unit 64 is used to detect a shift and pressure condition, which is then identified by the processing unit 61, and finally the activation unit 63 sends a driving command for the synchronous lifting.

Figure 4:
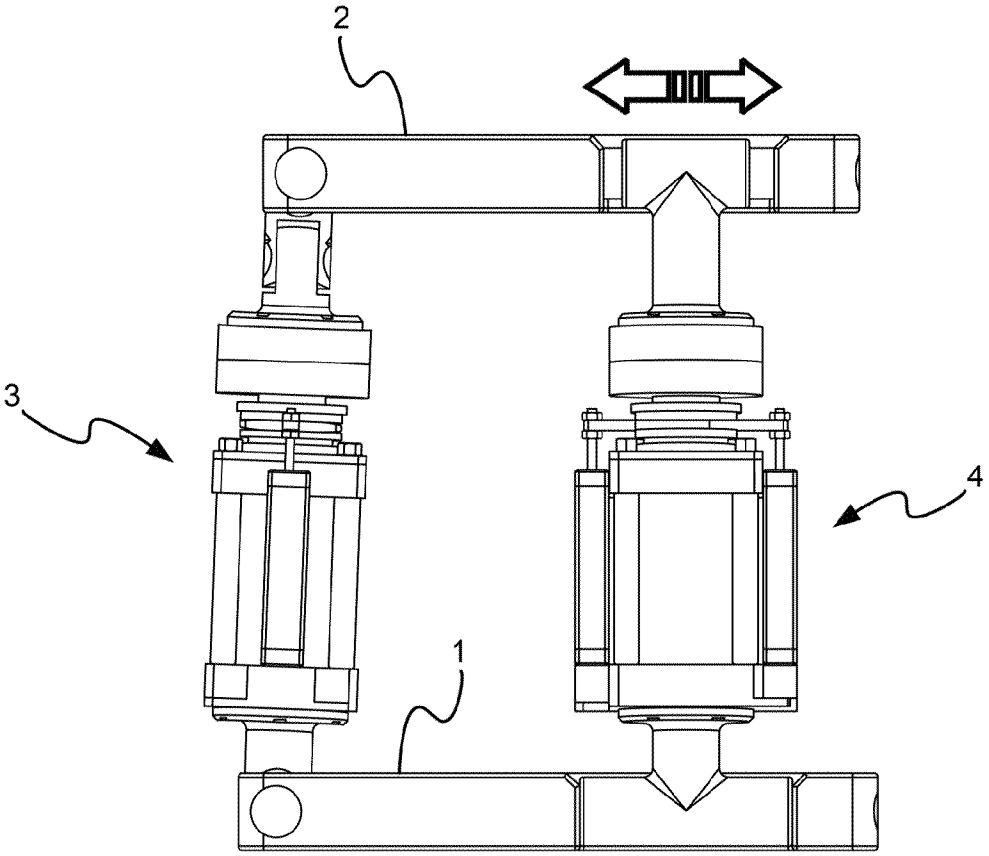
FIG. 4 is a schematic diagram of a translation motion according to the present invention.
Figure 5:
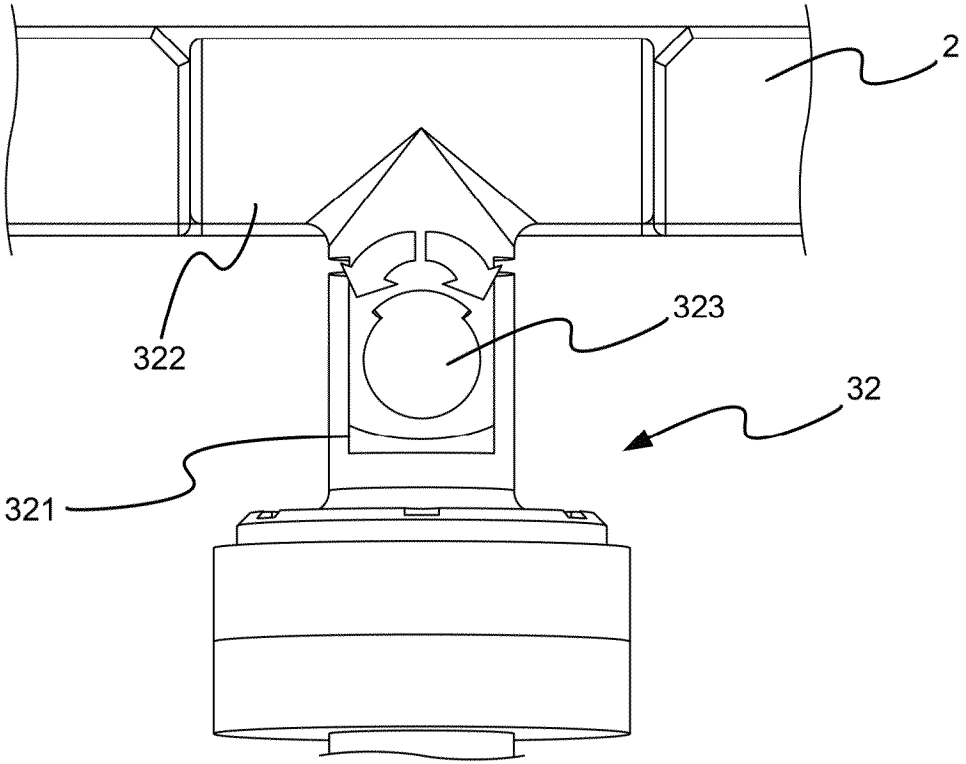
FIG. 5 is a schematic diagram of an inclination angle according to the present invention.
Figure 6:
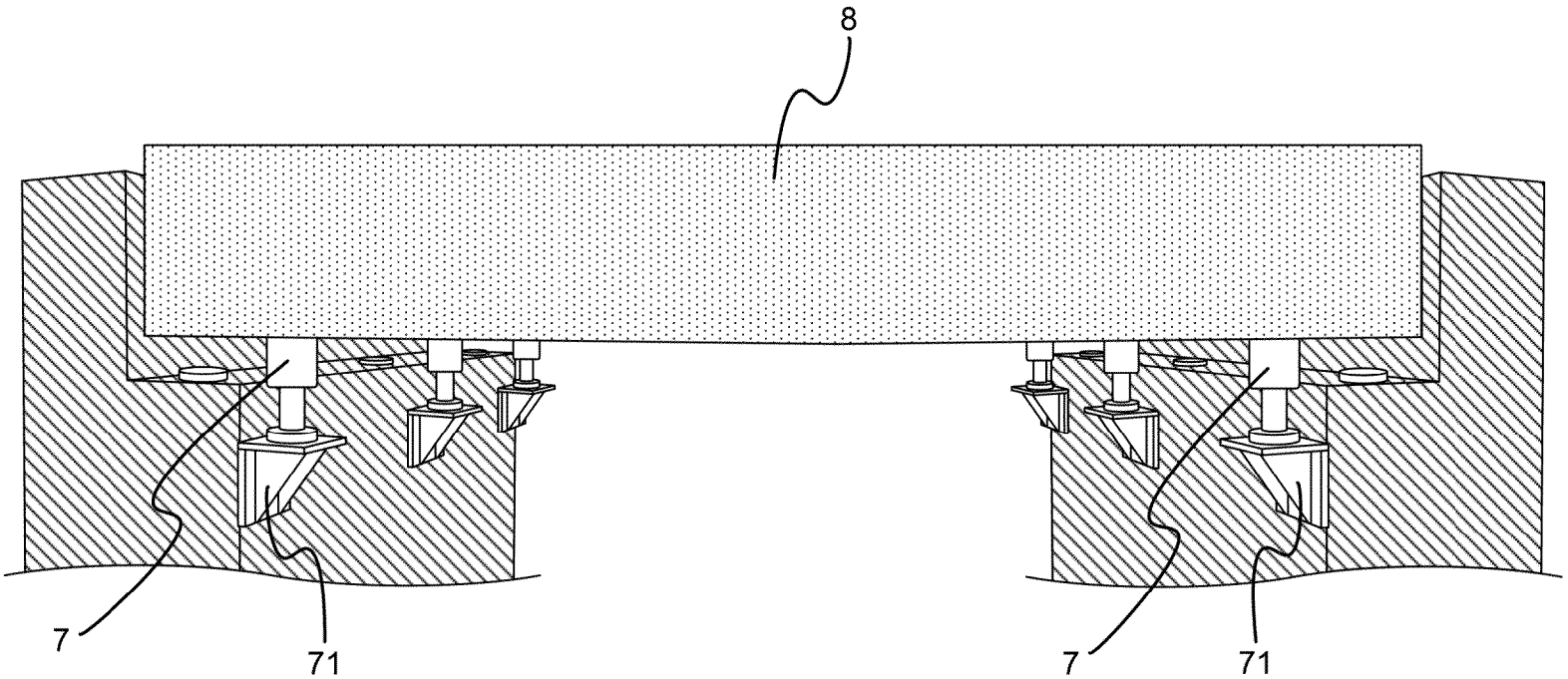
FIG. 6 (prior art)
FIG. 6 is a schematic diagram for illustrating a prior art supporting engineering method.

The present invention may perform a shift bridge adjustment for the 3-dimensional X1, X2, and X3 directions, and the rotational axis connection seat 32 may also have different bridge deck path inclination angle designs, where an inclination angle requirement may be performed by adjusting along the Y1 axis the curved path effect, so that the bridge lifting possesses the adjustment functions for bridge shift and inclination angle (as shown in FIG. 4 and FIG. 5).

Correspondingly, the present invention may achieve the following advantages: (1) easy construction method and operation, (2) easy repair and test, (3) adjustable inclination angle and shift distance, (4) capable of performing a synchronous bridge lifting engineering method, (5) reduced bracket use amount and easy alignment plane, (6) avoidable of bridge damage, (7) more lifting points by using a movable platform, making the lifting task more safety and efficiency, (8) more convenient install prior to a construction, program control in the course of construction, maintenance and repair after a construction by providing a modular design, (9) a synchronous lifting accuracy and reconstruction being finished through a test previously (calibration and adjustment among three jacks), (10) reduced danger by using a smart monitor and control process and problem location in construction being secured, (11) gathering the technology in various industries including construction sourcing, hydraulic system and mechanical and electrical integrated system, for a normally performed lifting engineering of bridge damage, and (12) capable of on line and effective repair, facilitating the government to guarantee safety of people's traffic.

In view of the above, the bridge lifting used three-axial parallel mechanism of the present invention may effectively overcome the demerits in the prior art, where a movable platform is contacted with a bridge body to avoid a concentrated strain, and a coordination among a respective rotational axis of a first, second and third lifting units are provided to achieve in a three-axial shift adjustment in a longitudinal, a lateral, and a side directions and a one-dimensional bridge deck inclination angle adjustment. Besides a use for the bridge lifting engineering, a test adjustment and calibration task prior to a construction, the bridge has the merits of maintenance on field, strengthening, elevation adjustment and river cross section promotion besides the bridge lifting function, and several to tens of three-axial parallel mechanisms are particularly used to control the synchronous bridge lifting engineering method so that the bridge deck is raised synchronously in its original posture to achieve the efficacy of on-line adjustment, avoid pollution, reconstruction, resource waste, traffic blockage and increased social cost resulting from tear-down of the bridge.

From all these views, the present invention may be deemed as being more effective, practical, useful for the consumer's demand, and thus may meet with the requirements for a patent.

The above described is merely examples and preferred embodiments of the present invention, and not exemplified to intend to limit the present invention. Any modifications and changes without departing from the scope of the spirit of the present invention are deemed as within the scope of the present invention. The scope of the present invention is to be interpreted with the scope as defined in the claims.

What is claimed is:

1. A bridge lifting used three axial parallel mechanism, comprising:

a stationary platform;

a movable platform, disposed corresponding to the stationary platform;

a first lifting unit, movably disposed at an end of the stationary platform with one end thereof and at an end of the movable platform with the other end;

a second lifting unit, movably disposed at an end of the stationary platform with one end thereof and end of the movable platform with the other end;

a third lifting unit, movably disposed at the other end of the stationary platform with one end thereof and end of the movable platform with the other end, wherein the first lifting unit comprises a jack, a rotational axis connection seat disposed at a top end of the jack, a pivot movably combined with the movable platform and the rotational axis connection seat, a male connector disposed at a bottom end of the jack, a pivot movably combined with the stationary platform and the male connector, and a shift sensor connected to the jack.

2. The bridge lifting used three axial parallel as claimed in claim 1, wherein the rotational axis connection seat comprises a connection seat combined with the jack, a sleeve movably combined with the connection seat, and a rotational axis connected to the connection seat and the sleeve.

3. The bridge lifting used three axial parallel as claimed in claim 1, wherein the second lifting unit comprises a jack, a pressure sensor male-connector disposed on the top of the jack, a pivot movably combined with the movable platform and the pressure sensor male-connector, a male connector disposed at the bottom end of the jack, a pivot movably combined with the stationary platform and the male connector, and a shift sensor connected to the jack.

4. The bridge lifting used three axial parallel as claimed in claim 1, wherein the third lifting unit comprises a jack, a pressure sensor male-connector disposed on the top of the jack, a pivot movably combined with the movable platform and the pressure sensor male-connector, a male connector disposed at the bottom end of the jack, a pivot movably combined with the stationary platform and the male connector, and a shift sensor connected to the jack.

5. The bridge lifting used three axial parallel as claimed in claim 1, wherein the first, second and third lifting units is further connected to a control mechanism.

6. The bridge lifting used three axial parallel as claimed in claim 5, wherein the control mechanism comprises a processing unit, an operational unit connected to the processing unit, an activation unit connected to the processing unit, a receiving unit connected to the processing unit, and an output unit connected to the processing unit.

7. A bridge lifting used three axial parallel mechanism, comprising:

a stationary platform;

a movable platform, disposed corresponding to the stationary platform;

a first lifting unit, movably disposed at an end of the stationary platform with one end thereof and at an end of the movable platform with the other end;

a second lifting unit, movably disposed at an end of the stationary platform with one end thereof and end of the movable platform with the other end;

a third lifting unit, movably disposed at the other end of the stationary platform with one end thereof and end of the movable platform with the other end, wherein the rotational axis connection seat comprises a connection seat combined with the jack, a sleeve movably combined with the connection seat, and a rotational axis connected to the connection seat and the sleeve.

8. A bridge lifting used three axial parallel mechanism, comprising:

a stationary platform;

a movable platform, disposed corresponding to the stationary platform;

a first lifting unit, movably disposed at an end of the stationary platform with one end thereof and at an end of the movable platform with the other end;

a second lifting unit, movably disposed at an end of the stationary platform with one end thereof and end of the movable platform with the other end;

a third lifting unit, movably disposed at the other end of the stationary platform with one end thereof and end of the movable platform with the other end, wherein the second lifting unit comprises a jack, a pressure sensor male-connector disposed on the top of the jack, a pivot movably combined with the movable platform and the pressure sensor male-connector, a male connector disposed at the bottom end of the jack, a pivot movably combined with the stationary platform and the male connector, and a shift sensor connected to the jack.

* * * * *